United States Patent [19]

Nelson

[11] Patent Number: 4,996,817

[45] Date of Patent: Mar. 5, 1991

[54] FURNITURE EDGE CONSTRUCTION

[76] Inventor: Thomas J. Nelson, 1424 N. Danube Rd., Fridley, Minn. 55432

[21] Appl. No.: 104,737

[22] Filed: Oct. 1, 1987

Related U.S. Application Data

[63] Continuation-in-part of Ser. No. 33,310, Mar. 31, 1987, abandoned.

[51] Int. Cl.[5] ..... E04C 2/38; E04F 19/02

[52] U.S. Cl. ..... 52/783; 52/829

[58] Field of Search ..... 52/783, 784, 813, 829, 52/824, 822, 656, 716; 312/140.3

[56] References Cited

U.S. PATENT DOCUMENTS

| | | | |
|---|---|---|---|
| 2,297,072 | 9/1942 | Raggio . | |
| 2,542,860 | 2/1951 | Clements . | |
| 2,705,820 | 4/1955 | Torrence . | |
| 2,717,187 | 9/1955 | Morgan et al. . | |
| 2,769,513 | 11/1956 | Smith . | |
| 3,077,012 | 2/1963 | Speraw . | |
| 3,386,209 | 6/1968 | Starcevic . | |
| 3,449,879 | 6/1969 | Bloom . | |
| 3,606,508 | 9/1971 | Burnes . | |
| 3,720,027 | 3/1973 | Sondergaard | 52/829 |
| 3,991,242 | 11/1976 | Tuttle | 52/829 |
| 4,386,482 | 6/1983 | Quinif . | |
| 4,558,553 | 12/1985 | Kolk . | |
| 4,663,912 | 5/1987 | Vinther | 52/822 |

*Primary Examiner*—John E. Murtagh

*Attorney, Agent, or Firm*—Dorsey & Whitney

[57] ABSTRACT

A watertight, durable, and attractive edge construction for furniture is provided that is especially designed for ease of installation while maintaining the aesthetic appeal of the furniture edge. The edge construction hereof provides for the snapable insertion of a side molding into the exposed sidewall of a furniture panel, and, through the provisions of designed-in recesses, allows for the expansion of the furniture and side molding material and for the dispersion of the bonding medium used to bond the panel and molding together. The invention is particularly adaptable for use in the construction of countertops or other furniture made from sheets of synthetic resin laminate bonded to support decking.

7 Claims, 2 Drawing Sheets

FURNITURE EDGE CONSTRUCTION

This is a continuation-in-part of application Ser. No. 033,310, filed Mar. 31, 1987, now abandoned.

TECHNICAL FIELD

The present invention relates to furniture construction. In particular, the invention pertains to the construction of wear-resistant edges on counter tops and the like.

BACKGROUND ART

Construction of counter tops, desk tops, and similar pieces of furniture often entails the use of panels having a top surface and exposed edges. The exposed edges of such panels are often unsightly and susceptible to damage, and require the use of decorative moldings to protect and beautify the exposed edge. Effective bonding of the moldings to the panel exposed edge, however, is difficult.

The construction of counter tops, table tops, desk tops, and other similar pieces of furniture using sheets of hard plastic laminate presents particular problems in protecting and beautifying exposed panel edges. In general, construction of furniture from plastic laminate entails the bonding of thin sheets of plastic laminate to support decking. The support decking is preferably a relatively inexpensive, yet sturdy, particle board or the like. While the combination of hard plastic laminate with support decking provides a sturdy, wear-resistant, and waterproof top surface, the exposed sidewalls of the combination present a particularly unsightly and damage susceptible cross section.

Various methods for providing a suitable edge to furniture surfaces constructed from plastic laminate bonded to support decking have been proposed. For instance, U.S. Pat. No. 2,717,187 entitled LAMINATED TABLE TOP WITH EDGING, U.S. Pat. No. 3,077,012 entitled COUNTER TOP CONSTRUCTION AND THE LIKE, and U.S. Pat. No. 3,606,508 entitled COUNTER TOP describe different ways for forming the edge of a laminated table or counter top. The extensive use of plastic laminate bonded to support decking in furniture construction, however, has justified a continuing effort on the part of the furniture industry to find more efficient, less expensive methods and materials for forming more durable and better looking edgings for counter tops, table tops, and the like.

SUMMARY OF THE INVENTION

The present invention provides a watertight, durable, and attractive molding to furniture having exposed edges, while at the same time providing for ease of installation and economy of fabrication materials. The invention is particularly adaptable to the construction of countertops and similar pieces of furniture formed from plastic laminate bonded to support decking.

In the instance of furniture constructed from plastic laminate bonded to support decking, a milled channel is provided in the exposed sidewall of the support decking to which the sheet of top skin plastic laminate is to be bonded. A covering for the exposed support decking sidewall is provided comprising a specially designed molding piece formed from medium density fiber board to which plastic laminate is rigidly bonded with a cold pressed urea glue. The molding includes a rearwardly protruding rib that is snapably received within the support decking milled channel. A channel is provided within the molding that enables an extremely close and watertight fit between the molding and the panel to which it is bonded, by providing a space for expansion of the panel and for receiving excess glue.

DETAILED DESCRIPTION OF THE DRAWINGS

Figure 1:
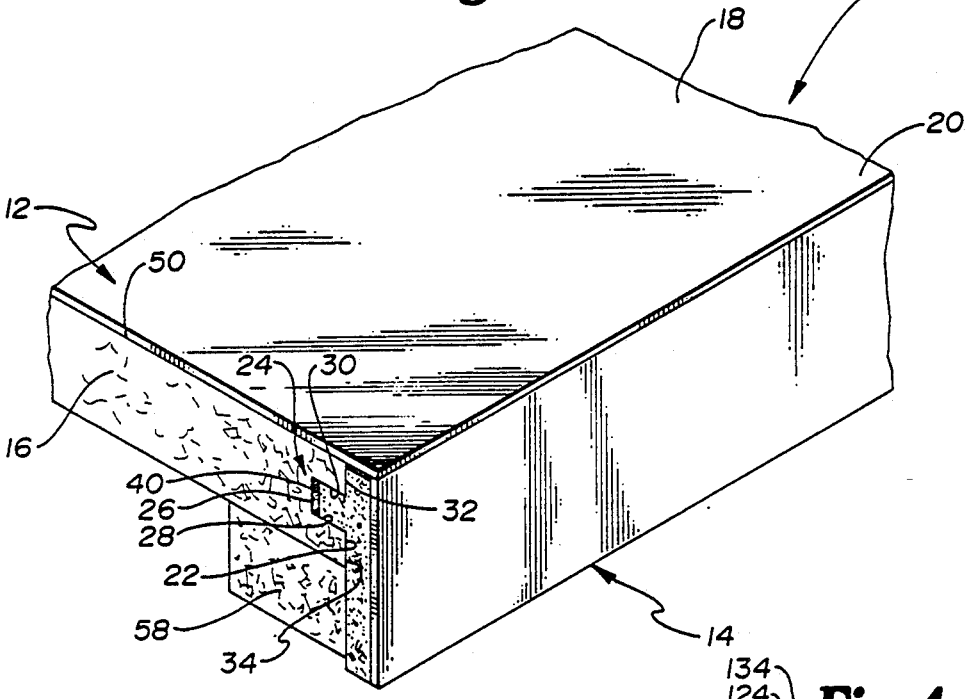
FIG. 1 is a fragmentary, perspective view of a counter top having a side molding in accordance with the invention.

Referring to the drawings, a counter top 10 having an edge in accordance with the present invention is depicted. The counter top 10 includes a top member 12 and side molding 14. It will be appreciated that, while the invention is described in conjunction with a counter top having a top member and side molding, the invention is equally applicable to other articles of furniture, and, moreover, is not restricted to edges formed by top and side members.

Top member 12 includes support decking 16 formed of, for instance, 45 psi particle board. A suitable plastic laminate top skin 18 is bonded to the support decking with, for instance, a low pressure contact adhesive. The plastic laminate can be, for example, of the kind manufactured by the Formica Corporation, and designated as model 920-58 Almond. A portion 20 of the plastic laminate top skin 18 overhangs the exposed sidewall 22 of support decking 16 by a distance equal to the width of molding 14.

Support decking 16 includes milled channel 24 along the support decking exposed sidewall 22. Milled channel 24 is generally rectilinear in cross section and includes end wall 26, and opposed bottom and top walls 28, 30. The channel 24 effectively separates the exposed sidewall 22 of support decking 16 into an upper sidewall surface 32 and a lower sidewall surface 34.

Molding 14 includes plastic laminate edge sheet 36 permanently, rigidly bonded to backing member 38 with a cold pressed urea glue. Backing member 38 comprises a strip of medium density fiberboard. A rearwardly protruding rib 40 extends from the rear surface of the backing member 38. The rib is generally rectilinear in cross section and includes rib end wall 42 and opposed rib top and bottom walls 44, 46. The height of the rib 42 is less than the depth of milled channel 24 such that a space 48 is presented between the end wall 26 of milled channel 24 and the end wall 42 of the rib 40 when the rib 40 is snapably received within the channel 24. The width of the rib 40, as measured between the rib bottom and top walls 44, 46, is substantially similar to the width of the milled channel 24 as measured between the milled channel bottom and top walls 28, 30, such that the rib 40 can be snapably received in a forced fit within milled channel 24.

Figure 2:
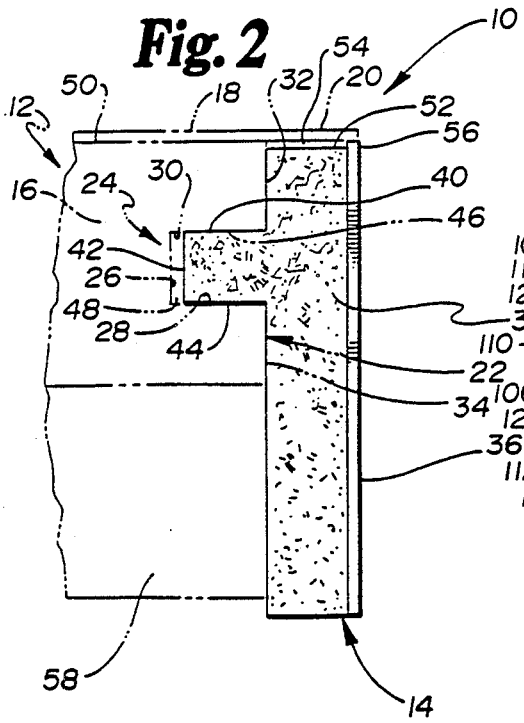
FIG. 2 is a side, elevational view of the counter top depicted in FIG. 1.

As is best depicted in FIG. 2, the height of the upper sidewall surface 32 of support decking exposed sidewall 22, as measured between the top wall 30 of milled channel 24 and the top surface 50 of support decking 16 is slightly larger than the height of the backing member 38 as measured from the top wall 46 of rib 40 to the backing member upper surface 52. A space 54 is thereby created between the backing member upper surface 52 and the overhanging portion 20 of the plastic laminate top skin 18.

Again referring to FIG. 2, a portion 56 of plastic laminate sheet 36 extends beyond the backing member upper surface 52 so as to be in abutting relationship to the underside of portion 20 of plastic laminate top skin 18 when the rib 40 of molding 14 is snapably received within channel 24 of support decking 16. A supporting bolster board 58 is fixedly attached to the lower surface of support decking 16 and the rear surface of backing member 38 of molding 14.

Figure 3:
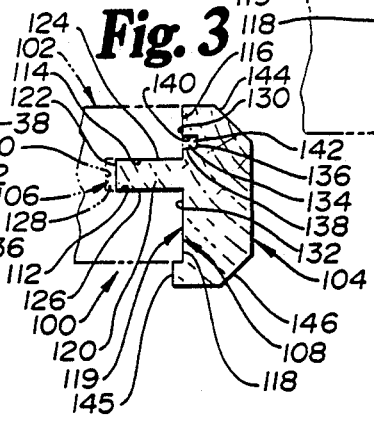
FIG. 3 is a side elevational view of a side molding in accordance with a second embodiment of the invention, phantom lines depicting a shelf top having an exposed edge.

Referring to FIG. 3, a shelf top 100 having an edge in accordance with the second embodiment of the present invention is depicted. The shelf top 100 includes a top member 102 and side molding 104. As depicted in FIG. 3, the side molding 104 is formed from a solid piece of wood, and top member 102 is similarly formed from a solid wood piece. It will be understood, however, that an embodiment of the invention depicted in FIG. 3 is not restricted to side molding made from solid wood members, and is equally applicable to shelf tops formed of, for instance, particle board with a suitable plastic laminate, or for instance, Kortron/E brand prefinished particle board as available from Williamette Industries of Bend, Oreg.

The top member 102 includes milled channel 106 along its exposed sidewall 108. Milled channel 106 is generally rectilinear in cross section and includes end wall 110, and opposed bottom and top walls 112, 114. The channel 106 effectively separates the exposed sidewall 108 of top member 102 into an upper sidewall surface 116 and a lower sidewall surface 118.

A rearwardly protruding rib 120 extends from the rear wall 119 of the side molding 104. The rib 120 is generally rectilinear in cross section and includes rib end wall 122 and opposed rib top and bottom walls 124, 126. The height of the rib 120 is less than the depth of milled channel 106 such that a space 128 is presented between the end wall 110 of milled channel 106 and the rear wall 122 of rib 120 when the rib 120 is snapably received within the channel 106. The width of the rib 120, as measured between the rib top and bottom walls 124, 126 is substantially similar to the width of the milled channel 106 as measured between the milled channel bottom and top walls 112, 114, such that the rib 120 can be snapably received in a forced fit within milled channel 106. The rib 120 effectively separates the molding rear wall 119 into an upper rear wall surface 130 and a lower rear wall surface 132.

The upper surface 130 of the rear wall 119 of molding 104 includes milled channel 134. Milled channel 134 is generally rectilinear in cross section and includes end wall 136, and opposed bottom and top wall 138, 140. The milled channel 134 presents a space 142 between the molding 104 and the upper surface 116 of exposed sidewall 108 of top member 102 when the top member 102 and molding 104 are assembled together.

Molding 104 includes decorative, upper and lower beveled edges 144, 146. A top member engaging lower lip 145 protrudes rearwardly from side molding 104.

Figure 4:
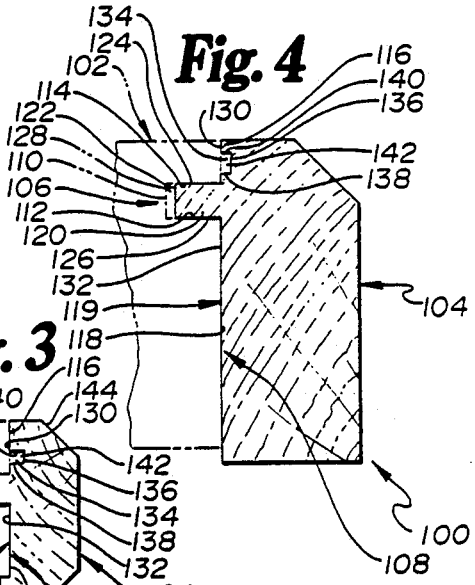
FIG. 4 is a side elevational view of a side molding in accordance with a third embodiment of the invention, phantom lines depicting a counter top having an exposed edge.

Referring to FIG. 4, a third embodiment of the present invention is substantially similar to the second embodiment described in conjunction with FIG. 3, and similar features in the drawing bear similar identifying numerals. It will be noted that the embodiment depicted in FIG. 4 does not include a decorative lower beveled edge, nor does it include a top member engaging, lowermost lip as is shown in conjunction with the second embodiment in FIG. 3.

Figure 5:
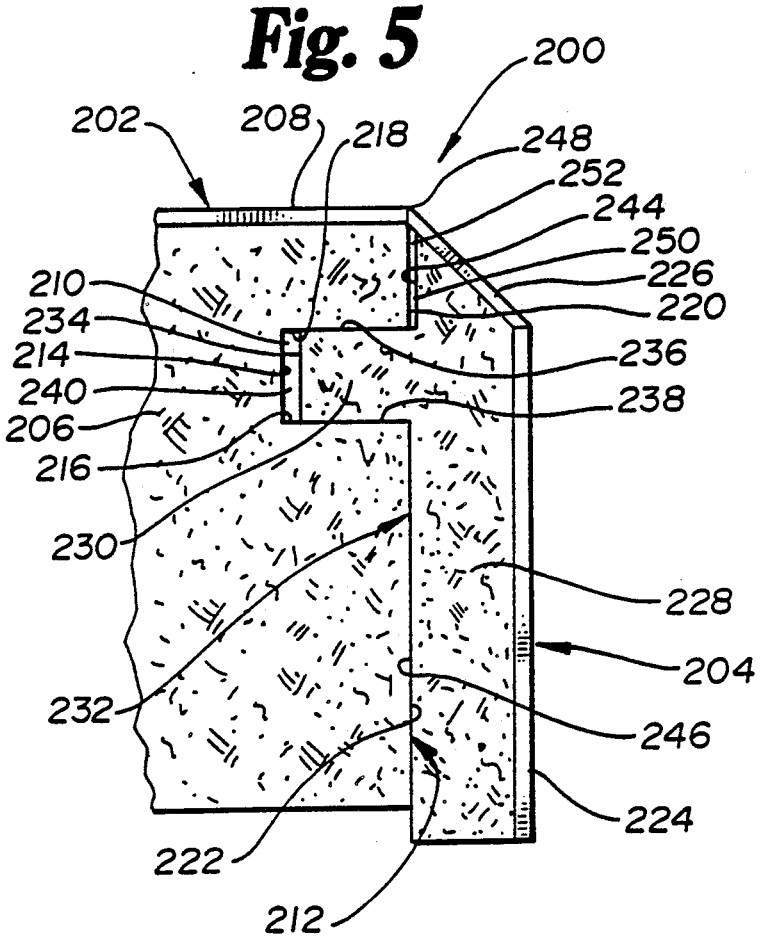
FIG. 5 is a fragmentary, side elevational view of a counter top having a side molding in accordance with a fourth embodiment of the invention.

Referring to FIG. 5, a counter top 200 having an edge in accordance with a fourth embodiment of the present invention is depicted. The counter top 200 includes top member 202 and side molding 204.

Top member 202 includes support decking 206 formed of, for instance, 45 psi particle board. A suitable plastic laminate top skin 208 is bonded to the support decking 206 with, for instance, low pressure contact adhesive.

Support decking 206 includes milled channel 210 along the support decking exposed side wall 212. Milled channel 210 is generally rectilinear in cross-section and includes end wall 214, and opposed bottom and top walls 216, 218. The channel 210 effectively separates the exposed side wall 212 of support decking 206 into an upper sidewall surface 220 and a lower sidewall surface 222.

Molding 204 includes front plastic laminate edge sheet 224 and upper plastic laminate edge sheet 226. Both sheets 224, 226 are permanently, rigidly bonded to a backing member 228 with a cold pressed urea glue. Backing member 228 comprises a strip of medium density fiberboard. Rearwardly protruding rib 230 extends from the rear wall 232 of the backing member 228. The rib is generally rectilinear in cross section and includes rib end wall 234, and opposed rib top and bottom walls 236, 238.

The height of the rib 230 of backing member 228 is less than the depth of milled channel 210 such that a space 240 is presented between the end wall 214 of milled channel 210 and the rear wall 234 of the rib 230 when the rib 230 is snapably received within the channel 210. The width of the rib 230, as measured between the rib top and bottom walls 236, 238 is substantially similar to the width of milled channel 210 as measured between the milled channel bottom and top walls 216, 218, such that the rib 230 can be snapably received in a force fit within milled channel 210.

The rib 230 effectively separates the rear wall 232 of molding 204 into an upper rear surface 244 and a lower rear surface 246. The upper, exposed margin 248 of upper plastic laminate edge sheet 226 extends slightly beyond the plane of the upper rear surface 244 of molding rear surface 232 so as to present a channel 250 between the upper margin 248 of the upper plastic laminate edge sheet 226 and the upper wall 236 of rib 230. The channel 250 presents a space 252 between the molding upper rear surface 244 and the upper sidewall surface 220 of top member 202 when the molding 204 and top member 202 are joined together.

Construction of a furniture edge in accordance with the present invention is accomplished by providing a support decking having a channel 24 milled therein. The support decking 16 can be preformed with the channel 24, or channel 24 may be formed with the use of a dado cutter at the time of construction. Next, a strip of water soluble glue is placed along the rear surface of the molding backing member 38 of molding 14 at the intersection of the bottom wall 44 of rib 40 with the rear surface of backing member 38. The glue is positioned so as to create a bond between the rear surface of backing member 38 and the lower sidewall surface 22. The rib 40 of molding backing member 38 is then snapably inserted into milled channel 24 of support decking 16.

A contact adhesive is next applied to the upper wall 54 of backing member 38 and the top surface 50 of support decking 16, as well as to the underside of laminate top skin 18. The plastic laminate top skin 18 is then bonded to support decking 16, allowing for the overhang portion 20 to extend beyond the exposed sidewall surface 22 of support decking 16, a distance greater than the width of molding 14. The overhang portion is then trimmed or routed so as to be flush with the plastic laminate surface 36 of molding 14.

As will be appreciated by those skilled in the art, particle board swells in volume as it absorbs liquid, and the contact of the water soluble glue with the lower sidewall surface 34 of support decking 16 will cause the fiberboard of support decking 16 in that area to expand, pivoting the upper surface 54 of backing member 38 towards the overhang portion 20 of plastic laminate top skin 18. Space 54 formed between the overhang portion 20 of plastic laminate top skin 18 and the upper surface 54 of backing member 38 provides a glue channel for the contact adhesive applied to the surface 54, allowing for the dispersion of the contact adhesive. The contact adhesive provides a watertight barrier between the intersection of the top skin 18 and plastic laminate 36 of molding 14, and the particle board of support decking 16. The space 48 between the rear wall 26 of channel 24 and end wall 42 of rib 40 allows for expansion of the rib 40 within the milled channel 24.

Referring to FIGS. 3 and 4, construction of a furniture edge in accordance with the second and third embodiments of the present invention is accomplished by first providing the top member 102 with milled channel 106. The top member can be preformed with the milled channel 106, or milled channel 106 may be formed with the use of a dado cutter at the time of construction. A bonding medium, preferably a water soluable glue, is next applied to the rear wall 119 of molding 104. The glue is preferably applied in a limited quantity only along the creases defined by the intersection of the rib top and bottom walls 124, 126 with the upper and lower surfaces 130, 132 of rear wall 119. The molding 104 and top member 102 are then assembled together with rib 120 snapably received within top member milled channel 106. The glue will accordingly spread out along the upper and lower surfaces 130, 132 of the molding rear wall 119. The space 142 presented by channel 134 provides a place for excess glue applied to the short upper surface 116 of rear wall 119 of molding 104 to collect.

Referring to FIG. 5, construction of a furniture edge in accordance with the fourth embodiment of the present invention is accomplished by providing a piece of support decking 206. A suitable plastic laminate top skin 208 is then bonded to the support decking 206. The support decking 206 and the edge of the plastic laminate top skin 208 are machined so as to be flush. A milled channel 210 is then machined in support decking 206, with the use of a dado cutter. Next, a strip of water soluble glue is placed along the surface of the molding backing member 228 of molding 204 at the intersections of the rib top and bottom walls 236, 238 with the upper and lower rear surfaces 244 and 246 of the molding rear surface 232. The molding 204 and top member 202 are then joined together with the rib 230 snapably received within top member milled channel 240. The glue will accordingly spread out along the upper and lower surfaces 244 and 246 of the molding rear wall 232 of molding 204. The space 248 presented by channel 246 provides a place for excess glue applied to the upper rear surface 244 of molding rear wall 232 to collect.

I claim:

1. An edge structure for a piece of furniture or the like having a first sheet of laminate bonded to the primary support surface of a support decking, said support decking presenting an exposed sidewall at an angle to said primary support surface, comprising:

structure defining a recess along said exposed sidewall, said recess presenting a recess depth and a recess width;

a side molding comprising a backing member having an inner surface, an outer surface and an edge surface and a sidewall sheet of laminate bonded to said outer surface, said backing member inner surface including a projection having a projection height less than said recess depth, and a projection width substantially similar to said recess width whereby said projection is snapably receivable in said recess in a forced fit, said first sheet of laminate including a first overhand laminate portion overhanging said support decking exposed sidewall, said sidewall sheet of laminate including a sidewall sheet overhang portion extending slightly beyond said edge defining the depth of a glue receiving channel between said first overhang portion and said edge surface when said projection is snapably received with said recess.

2. A joint for abuttably connecting the edges of support decking having a laminate bonded thereon, comprising;

a first support decking member having a top surface, a sidewall surface, and a lower surface;

structure defining a channel along said sidewall surface, said channel presenting a channel depth and a channel width;

a first sheet of laminate bonded to said top surface, including a first overhang portion extending beyond said sidewall surface;

a second support decking member having an outer surface, an inner surface, and an edge surface;

a rib projecting from said inner surface, said rib having a rib height less than said channel depth and a rib width substantially similar to said channel width, whereby said rib is snapably receivable in said channel in a forced fit; and a second sheet of laminate bonded to said outer surface, including a second overhang portion extending slightly above said edge surface, whereby said second overhang portion defines the depth of a glue receiving channel between said first overhang portion and said edge surface when said rib is snapably received within said channel.

3. The joint to claim 2 wherein said channel is oriented substantially parallel to said top surface.

4. The joint of claim 2 wherein said channel width is substantially uniform along said sidewall surface.

5. The joint of claim 2 wherein said channel width is substantially uniform along said channel depth.

6. The joint of claim 2 wherein said first and second support decking member consist of fiberboard.

7. The joint of claim 2 further comprising a support member fixedly attached to said lower surface of said first support decking member and said inner surface of said second support decking member.

* * * * *